US005228677A

United States Patent [19]

Asakawa

[11] Patent Number: 5,228,677

[45] Date of Patent: Jul. 20, 1993

[54] PAPER-SUPPLYING CASSETTE FOR AN IMAGE FORMING APPARATUS

[75] Inventor: Yoshiyuki Asakawa, Higashiosaka, Japan

[73] Assignee: Mita Industrial Co., Ltd., Osaka, Japan

[21] Appl. No.: 917,980

[22] Filed: Jul. 24, 1992

[30] Foreign Application Priority Data

Aug. 14, 1991 [JP] Japan ..... 3-228857

[51] Int. Cl.[5] ..... B65H 1/14

[52] U.S. Cl. ..... 271/126; 271/164

[58] Field of Search ..... 271/126, 127, 162, 164

[56] References Cited

U.S. PATENT DOCUMENTS 4,793,606 12/1988 Yasuoka ..... 271/127 X 5,078,380 1/1992 Kitazawa ..... 271/127 X

*Primary Examiner*—Richard A. Schacher

*Attorney, Agent, or Firm*—Wenderoth, Lind & Ponack

[57] ABSTRACT

A paper supplying cassette for an image-forming apparatus is capable of eliminating a watch-and-wait time necessary for a cassette withdrawal operation and of preventing a driving system from being broken. A cassette plate with papers carried thereon is movable to an upper paper supplying position and a lower withdrawal position. A holding plate moves the cassette plate to the paper supplying position. A transmission mechanism transmits driving power from a motor to the holding plate. An interlocking arrangement disconnects the transmission mechanism from the holding plate when the cassette is withdrawn.

12 Claims, 3 Drawing Sheets

PAPER-SUPPLYING CASSETTE FOR AN IMAGE FORMING APPARATUS

BACKGROUND OF THE INVENTION

1. Field of the Invention

The present invention relates to a paper supplying cassette for an image forming apparatus, in particular to an improvement of the paper supplying cassette wherein a paper supplying or supporting plate with papers or paper sheets carried thereon is moved to a paper supplying position when the papers are to be supplied.

Recently, in a front loading type image forming apparatus, it has been proposed in order to improve a set condition of papers that a cassette plate with the papers carried thereon be moved to an upper paper supplying position by means of a motor when the papers are to be supplied. In such arrangement, a gear mounted on a side of a holding plate for moving the cassette plate is engaged with a gear mounted on an output shaft of the motor. A stopper prevents a paper supplying cassette with the cassette plate housed therein from being removed until movement of the cassette plate to a lower paper withdrawal position thereof is finished. This is for the purpose of prevention of damage to a gear mechanism that would occur if the cassette were to be removed when the motor still is operating to lower the cassette plate. In such arrangement, both upward and downward movement of the cassette plate usually is carried out by forward rotation and by reverse rotation of the motor. Accordingly, when said paper supplying cassette is to be removed, such withdrawal cannot occur during a time from starting of the motor by operation of a switch for a withdrawal operation until arrival of the cassette plate at the lower paper withdrawal position (about 3 seconds). Thus, operator time is wasted and the operator may become impatient. In addition, there is the possibility that the operator may attempt to forcibly withdraw the paper supplying cassette before the necessary watch-and-wait time is over, thereby breaking driving systems such as gear mechanism and the motor.

SUMMARY OF THE INVENTION

The present invention has been achieved taking such above actual circumstances into consideration, and it is an object of the present invention to provide a paper supplying cassette for an image forming apparatus capable of eliminating any watch-and-wait time period necessary for a withdrawal operation and of preventing a driving system from being broken.

In order to achieve such object, the present invention has the following construction. That is to say, the paper supplying cassette for an image forming apparatus includes a cassette plate for carrying paper sheets thereon and is movable to an upper paper supplying position and a lower paper withdrawal position. A holding plate moves the cassette plate to the paper supplying position. A transmission mechanism transmits driving power from a motor to holding plate and controls movement thereof. Interlocking means disconnects the holding plate from the transmission mechanism when the cassette is withdrawn. As soon as the transmission mechanism is disconnected by the cassette withdrawal operation, the cassette plate is isolated from the motor. Thereby, the paper supplying cassette can be withdrawn immediately. All connection of the cassette plate with the motor through the transmission mechanism is released by the cassette withdrawal operation, and thus the cassette can be removed without requiring a watch-and-wait time for the motor to lower the cassette plate. Accordingly, breakage of driving systems such as the transmission mechanism and motor that would result from premature withdrawal can be prevented.

DETAILED DESCRIPTION OF PREFERRED EMBODIMENTS

The present invention will be described in detail below with reference to a preferred embodiment thereof.

Figure 2:
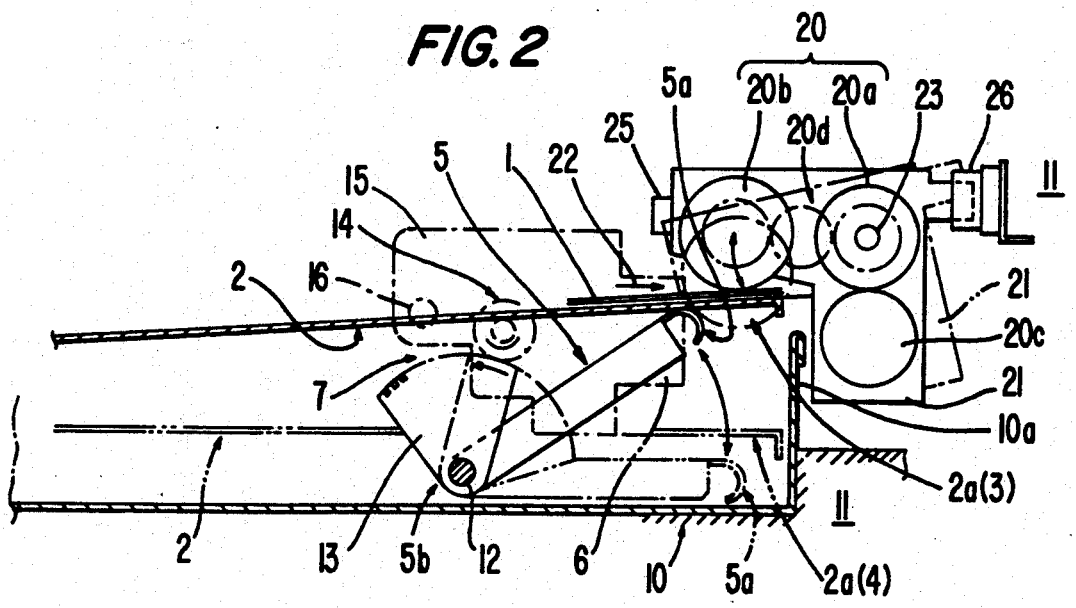
FIG. 2 is a longitudinally sectioned side view of such main parts showing a corresponding relation between the paper supplying cassette and paper supplying rollers.
Figure 6:
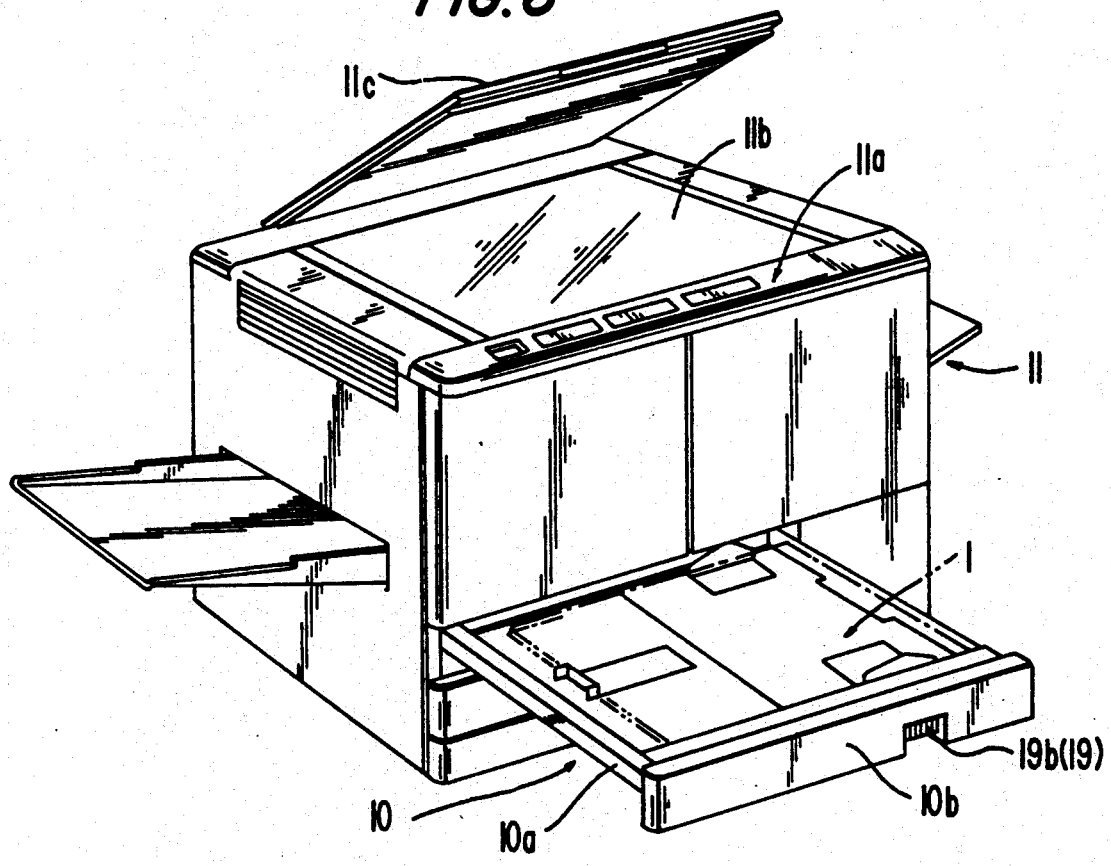
FIG. 6 is a perspective view showing a body of an image forming apparatus with the paper supplying cassette withdrawn therefrom.

FIG. 2 shows in section the main parts of a preferred embodiment of a paper supplying cassette for an image forming apparatus according to the present invention. Referring to FIG. 2, a cassette plate 2 with papers or paper sheets 1 carried thereon is arranged with a paper supplying cassette body or casing 10 so as to be movable to an upper paper supplying position 3 (shown by solid lines) and a lower insertion and withdrawal position 4 (shown by dashed lines). Paper supplying cassette casing 10 is engagedly supported in a body 11 of an image forming apparatus so as to be insertable into and withdrawn from body 11. A bent forward end portion **5*a* of a holding plate 5 is engaged with a lower portion of a leading end portion 2*a* of cassette plate 2, so that end portion 2*a* of the cassette plate 2 may be lifted to the upper paper supplying position 3 from the lower insertion and withdrawal position 4 by a lifting movement of holding plate 5. That is to say, a base portion 5*b* of the holding plate 5 is fixedly mounted on a support shaft 12 that is rotatably supported on the cassette casing 10. A segment gear 13 is fixedly mounted on one end portion of support shaft 12. A pinion 14 engaged with segment gear 13 is rotatably mounted on a gear case 15 that is rotatable about a support shaft 16 supported on the cassette casing 10. Shaft 16 functions as a fulcrum. Such structure operates as a transmission mechanism 7 that may be engaged and disengaged. Plate 5 thus may be rotated counterclockwise (as shown in FIG. 2) by rotating pinion 14 clockwise, and forward end portion 2*a* of the cassette plate 2 thus will be moved from the lower insertion and withdrawal position 4 to the upper paper supplying position 3 by end portion 5*a*. A paper supplying roller assembly 20 provided within the body 11 of the image forming apparatus (refer to FIG. 6) is arranged at the paper supplying position 3, so that an uppermost paper sheet 1 on the cassette plate 2 moved to the paper supplying position 3 may be conveyed in a paper supplying direction 22**.

Figure 3:
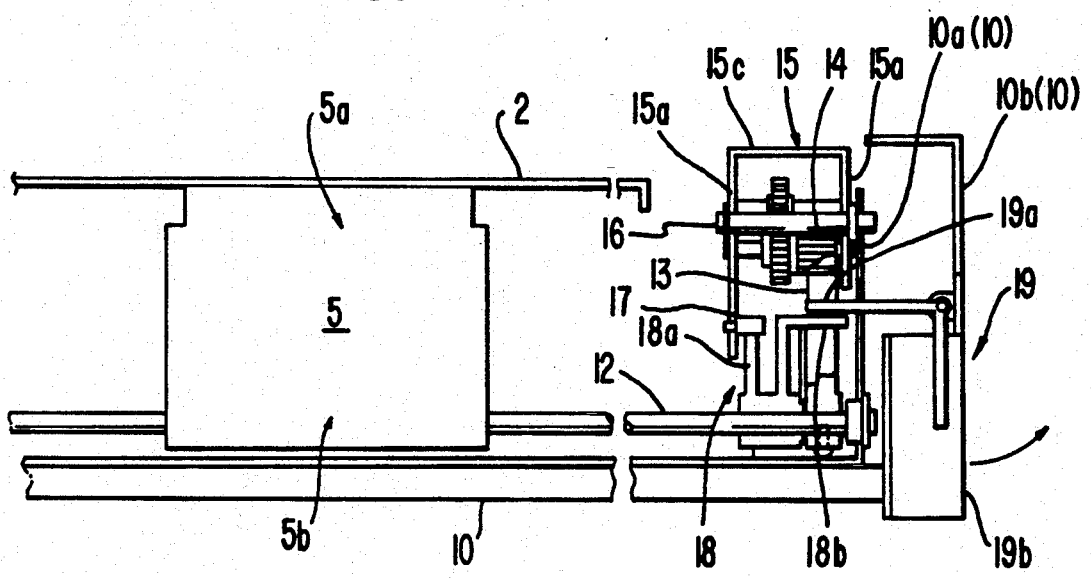
FIG. 3 is a front view showing the main parts of the paper supplying cassette.
Figure 4:
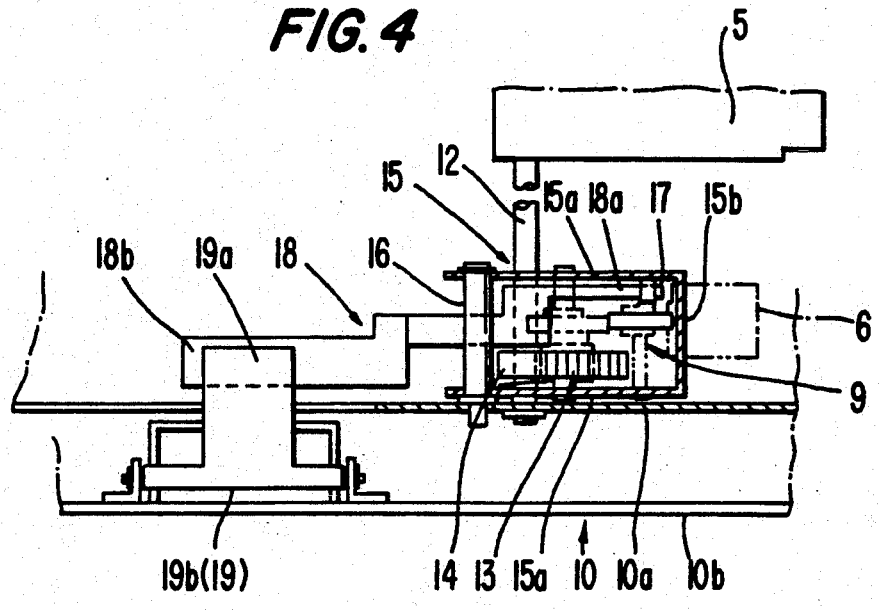
FIG. 4 is a broken plan view showing the main parts of the paper supplying cassette.

Gear case 15 is made from steel plate and includes spaced side walls 15*a* (refer to FIG. 4) that are integrally connected by a rear wall 15*b* and a crown wall 15*c* (refer to FIG. 3). Horizontal supporting shaft 16, a base portion of which is fixedly screwed into a frame member 10*a* of the cassette casing 10, extends into shaft holes formed in side walls 15*a*. Pinion 14 is mounted at an almost central position between walls 15*a*. A motor 6 is fixedly mounted on rear wall 15*b*, and a gear mechanism 9 is being disposed between motor 6 and the pinion 14 so that the pinion 14 may be driven by the motor 6.

Figure 5:
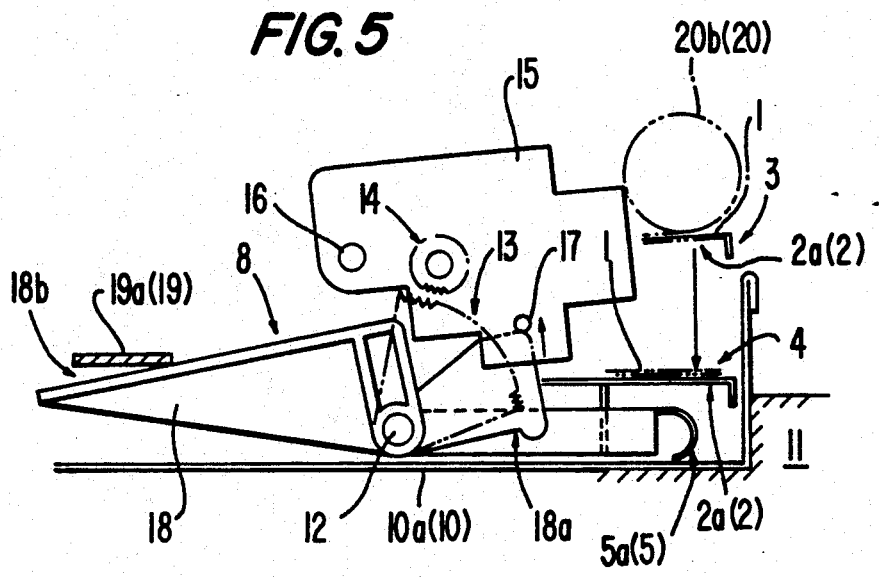
FIG. 5 is a schematic view illustrating an operation of disconnection of a transmission mechanism by means of interlocking means to enable the paper supplying cassette to immediately assume an insertion and withdrawal position.

An inner of the side walls 15*a* of the gear case 15 is provided with an engaging pin 17 (refer to FIGS. 1 and 3) projected from an inner surface thereof, so that the gear case 15 may be moved upward with the supporting shaft 16 as a fulcrum by moving engaging pin 17 upwardly by interlocking or disconnecting means 8 (refer to FIG. 5). Thus, the pinion 14 can be separated from the segment gear 13, to thereby allow the cassette plate 2 positioned at the paper supplying position 3 to drop downwardly to the lower insertion and withdrawal position 4. That is, upon separating the pinion 14 from the segment gear 13, the holding plate 5 no longer maintains the cassette plate 2 in upper position 3, but rather is rotatable. Thus, the cassette plate 2 is allowed to fall downwardly to the insertion and withdrawal position 4 due to the weights of the cassette plate 2 and the paper sheets 1 themselves. Since the uppermost paper sheet is removed from paper supplying roller assembly 20, it then is possible to withdraw the paper supplying cassette from the body 11 of the image forming apparatus (refer to FIG. 6). Accordingly, in the present preferred embodiment, it is not required to reversely rotate the motor 6 to the lower plate 2. Rather, the motor 6 is used only for raising the cassette plate 2 from the lower insertion and withdrawal position 4 to the upper paper supplying position 3. Motor 6 thus is driven exclusively in a single direction. Thus, an advantage is provided in that the control system can be still further simplified.

Figure 1:
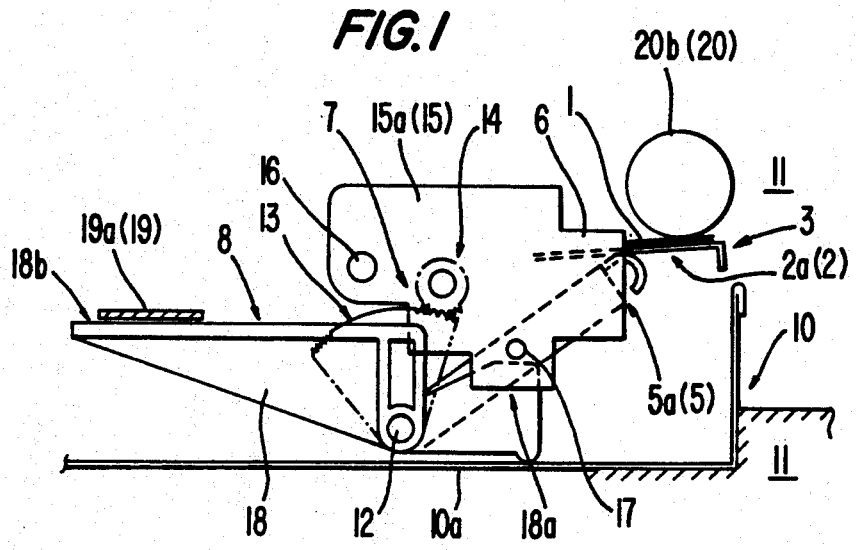
FIG. 1 is a schematic side view showing main parts of one preferred embodiment of a paper supplying cassette for an image forming apparatus according to the present invention.

The interlocking or disconnecting means 8, as shown in FIG. 1, comprises a lever 18 rotatably supported on the supporting shaft 12. An upper portion of one end 18*a* of lever 18 is aligned to abut a lower part of the engaging pin 17 mounted on the side wall 15*a* of the gear case 15. An L-shaped operating member 19 (refer to FIG. 3) is pivoted on a front surface side of an outer frame 10*b* provided outwardly of frame member 10*a* of the cassette casing 10. An end portion 19*a* of member 19 abuts an upper portion of an end 18*b* of the lever 18. Accordingly, upon an operator pulling a base portion 19*b* of operation member 19, as shown by the arrow in FIG. 3, end portion 19*a* is lowered and thereby pushes downwardly the end 18*b* of the lever 18. This moves end 18*a* and thereby engaging pin 17 upwardly, thus moving the gear case 15 upwardly. The gear case 15 thus is rotated counterclockwise about the fulcrum of the supporting shaft 16 to thereby separate the pinion 14 from the segment gear 13. As a result, the forward end portion 2*a* of the cassette plate 2 is allowed to fall downwardly from the upper paper supplying position 3 to the lower insertion and withdrawal position 4 (refer to FIG. 5). At such position 4, the paper sheets 1 carried on the cassette plate 2 are spaced from the paper supplying roller assembly 20, so that the paper supplying cassette can be smoothly withdrawn together with the paper sheets 1 without resistance. In short, a watch-and-wait time period that would be necessary with reverse rotation of the motor 6 is not required, in contrast to conventional paper 20 supplying cassettes. Thus, upon an operator operating the member 19, the paper supplying cassette can be withdrawn without delay. Accordingly, operator time is not wasted, and the driving system can be prevented from being broken.

The paper supplying roller assembly 20, as shown in FIG. 2, comprises a pair of forwarding rollers 20*a*, 20*b*, that is a front forwarding roller 20*a* and a rear forwarding roller 20*b*, and an intermittent backing roller 20*c* slidably urged toward one forwarding roller 20*a*. Such rollers are rotatably mounted on a plate frame 21 that is pivotable about an axis 23 defined by the shaft of the forwarding roller 20*a*. Rotary driving power is transmitted to the forwarding roller 20*a* from a driving source provided in the body 11 of the image forming apparatus through a transmission mechanism and is transmitted to the other forwarding roller 20*b* through a transmission gear 20*d*. Plate frame 21 is provided at one end thereof with a reflection-type photo-detector 25 for detecting an existence of the paper sheet 1. A photo-detector 26 is fixedly mounted on the body 11 for detecting a relative horizontal positioning of the forwarding rollers 20*a*, 20*b* of a front upper limit position of the cassette plate 2.

In the paper supplying cassette having the above described construction, the paper sheets 1 are carried in a stack on the cassette plate 2. The cassette is inserted into the body 11 to an inserted position, and a front safety switch (not shown) is turned on. Thereupon, the motor 6 starts to rotate the pinion 14 to thus rotate segment gear 13 counterclockwise as shown in FIG. 2. The holding plate 5 thereby is rotated in an upward direction, such that end portion 5*a* pushes upwardly the bottom surface of the forward end portion 2*a* of the cassette plate 2. Thus, the cassette plate 2 is moved from the lower insertion and withdrawal position 4 to the paper supplying position 3. Thereupon, the uppermost paper sheet 1 on the cassette plate 2 is brought into contact with the forwarding roller 20*b* and can be supplied and conveyed. In addition, when the motor 6 is to be started, existence of the paper sheet 1 is detected by reflection-type photo-detector 25. The motor 6 is started only when the paper sheet 1 is detected on the cassette plate 2, while the motor 6 is not started when the absence of a paper sheet is displayed on an operating panel 11*a* when the paper sheet 1 is not present on the cassette plate 2 (refer to FIG. 6). Furthermore, referring to FIG. 6, reference numeral 11*b* designates a contact glass and reference numeral 11*c* designates a manuscript pressing cover.

Stoppage of the above described upward movement of the cassette plate 2, that is setting of the cassette plate 2 at the paper supplying position 3, is achieved by stopping the motor 6 at a point in time when the intended horizontal position of forwarding rollers 20*a*, 20*b* is detected by photo-detector 26, thus functioning as a front upper limit detecting sensor. Accordingly, at a point in time when the cassette plate 2 is moved to the paper supplying position 3 the paper sheet 1 is brought into contact with the forwarding roller 20*b* to move both forwarding rollers 20*a*, 20*b* to the desired horizontal position. Thereby, preparation for the supply and conveyance of the paper sheets is completed. Although not shown, as soon as the operator turns on a copying start switch on the image forming apparatus, the supply and conveyance of the paper sheets is started in timed sequence with the starting of an optical system within the apparatus 11.

When it is desired to remove the paper supplying cassette from the body 11 of the image forming apparatus, for example after the completion of copying, the operator pulls the base portion 19*b* e of the operating member 19 forwardly. This rotates the gear case 15 counterclockwise as shown in FIG. 5 about the axis of supporting shaft 16, via the lever 18. Thereby, the pinion 14 is separated from the segment gear 13. This enable the forward end portion 2*a* of the cassette plate 2 to fall downwardly to the lower insertion and withdrawal position 4. Thus, the paper supplying cassette including the cassette plate 2 and the paper sheets 1 thereon can be withdrawn from body 11 without delay. Accordingly, a watch-and-wait time for lowering of the cassette plate is not required, operator time is not wasted, and the driving system is not subject to being broken, all such advantages being in contrast to conventional paper supplying cassettes. Also, the motor 6 need not be driven in opposite directions, but rather is driven in only a single direction to move the cassette plate 2 upwardly. Thereby is achieved the additional advantage that overall system controls are simplified.

As described above, according to the present invention, the holding plate for moving the cassette plate to the paper supplying position, the transmission mechanism for transmitting driving power from the motor to the holding plate so as to activate and deactivate movement of the holding plate, and the interlocking means for interrupting connection between the transmission mechanism and the holding plate when the cassette is to be removed all are mounted on and part of the cassette. Thus, the transmission mechanism is disconnected as a result of a cassette withdrawal operation by the interlocking means. Thereby, the cassette plate instantaneously is isolated from action of the motor, and as a result the cassette can be removed without delay. In short, the cassette can be withdrawn without delay without requiring a watch-and-wait time, without waste of operator time, and without danger of breaking the driving system.

The transmission mechanism and interlocking means of the invention are not intended to be limited to the disclosed preferred embodiment. Other engaging mechanisms, cam mechanisms 20 and the like, capable of transmitting driving power from the motor so as to achieve the disclosed functions, may be used as the transmission mechanism. In addition, it goes without saying that link members, other lever members, electromotive actuators, such as solenoids, various types of cylinder devices and the like, may be used as the interlocking means.

I claim:

1. A paper supplying cassette to be inserted into and withdrawn from an image forming apparatus, said cassette comprising:

a cassette casing;

a cassette plate for support of paper sheets and positioned for movement relative to said cassette casing between a withdrawal position and a paper supplying position;

a holding plate mounted on said cassette casing for movement relative thereto in a direction to move said cassette plate from said withdrawal position to said paper supplying position;

a single motor supported by said cassette casing and operable to generate driving power in a single direction;

a transmission mechanism mounted on said cassette casing for transmitting said driving power from said motor to said holding plate to move said holding plate in said direction; and means mounted on said cassette casing for disconnecting said transmission mechanism and interrupting transmission thereby of said driving power to said holding plate, such that said cassette plate then is movable from said paper supplying position to said withdrawal position independently of operation of said motor.

2. A cassette as claimed in claim 1, wherein said disconnecting means comprises means for initiating a cassette withdrawal operation.

3. A cassette as claimed in claim 1, wherein said paper supplying position is an upper position of said cassette plate relative to said cassette casing, and said withdrawal position is a lower position of said cassette plate relative to said cassette casing, whereby upon operation of said disconnecting means to disconnect said transmission mechanism said cassette plate lowers from said paper supplying position to said withdrawal position and moves said holding plate relative to said cassette casing opposite to said direction.

4. A cassette as claimed in claim 1, wherein said holding plate is fixed to a support shaft mounted on said cassette casing for rotation relative thereto about an axis of said support shaft, whereby said movement of said holding plate in said direction is about said axis.

5. A cassette as claimed in claim 4, wherein said transmission mechanism comprises a gear fixed to said support shaft, and means engaging said gear for rotating said gear and said support shaft about said axis.

6. A cassette as claimed in claim 5, wherein said gear comprises a segment gear.

7. A cassette as claimed in claim 5, wherein said rotating means comprises a pinion receiving said driving power from said motor and meshing with said gear.

8. A cassette as claimed in claim 7, wherein said transmission mechanism further comprises a gear case mounted on said cassette casing for rotation relative thereto about a second axis.

9. A cassette as claimed in claim 8, wherein said pinion and said motor are mounted on said gear case, and said disconnecting means is operable to rotate said gear case about said second axis to thereby move said pinion out of meshing engagement with said gear, thereby interrupting transmission of said driving power from said motor to said support shaft.

10. A cassette as claimed in claim 9, wherein said disconnecting means comprises a lever rotatably mounted on said support shaft and adapted to, upon rotation of said lever about said support shaft, rotate said gear case about said second axis.

11. A cassette as claimed in claim 10, wherein said gear case includes an engaging pin, and said lever includes an arm to abut said engaging pin to rotate said gear case.

12. A cassette as claimed in claim 10, wherein said disconnecting means further comprises an operating member pivotally mounted on said cassette casing and having a portion operable for, upon pivoting movement of said member, rotating said lever about said support shaft to cause rotation of said gear case about said second axis.

* * * * *